US005098223A

United States Patent [19]

Schoenherr et al.

[11] Patent Number: 5,098,223

[45] Date of Patent: Mar. 24, 1992

[54] GUTTER FERRULE

[76] Inventors: Curtis A. Schoenherr; Glenn C. Pesti, both of 34203 James J. Pompo, Fraser, Mich. 48026

[21] Appl. No.: 468,752

[22] Filed: Jan. 24, 1990

[51] Int. Cl.[5] ..... E04D 13/06

[52] U.S. Cl. ..... 405/119; 52/11; 248/48.1

[58] Field of Search ..... 405/119, 120, 121, 122, 405/123; 52/11, 16; 248/48.1, 48.2; 141/331

[56] References Cited

U.S. PATENT DOCUMENTS

| | | | |
|---|---|---|---|
| 1,940,369 | 12/1933 | Peal | 248/48.1 |
| 2,144,225 | 1/1939 | Neisworth | 248/48.1 |
| 2,672,832 | 3/1954 | Goetz | 52/12 |
| 2,733,629 | 2/1956 | Vogt | 248/48.1 X |
| 2,761,642 | 9/1956 | Rachlin | 248/48.1 |
| 2,827,931 | 3/1958 | Melvin | 141/331 |
| 2,870,242 | 1/1959 | Wilkerson | 174/135 |
| 2,928,634 | 3/1960 | Bender | 248/48.2 |
| 3,340,653 | 9/1967 | Steeg | 52/11 |
| 3,726,051 | 4/1973 | Kellis et al. | 52/11 |
| 3,915,418 | 10/1975 | D'Amato | 52/11 X |
| 4,314,683 | 2/1982 | Cunning | 248/48.2 |

FOREIGN PATENT DOCUMENTS

| | | | |
|---|---|---|---|
| 2170121 | 7/1986 | United Kingdom | 141/331 |

*Primary Examiner*—David H. Corbin
*Attorney, Agent, or Firm*—Daniel H. Bliss

[57] ABSTRACT

This invention is directed to a gutter ferrule comprised of a plastic material, such as ABS or polypropolene. The advantages of producing the ferrule from a plastic material include the ability to injection mold the ferrule such that the entire piece is continuous without any seams. The plastic ferrule is generally a tubular shape in which one end has a funnel portion formed to it in a continuous fashion. The funnel portion enables a worker to more easily guide a support spike through the gutter walls and gutter ferrule into a support structure such as the eave of a roof. In the preferred embodiment, the funnel portion has a generally rectangular opening, however, other shapes offer the same advantages.

16 Claims, 2 Drawing Sheets

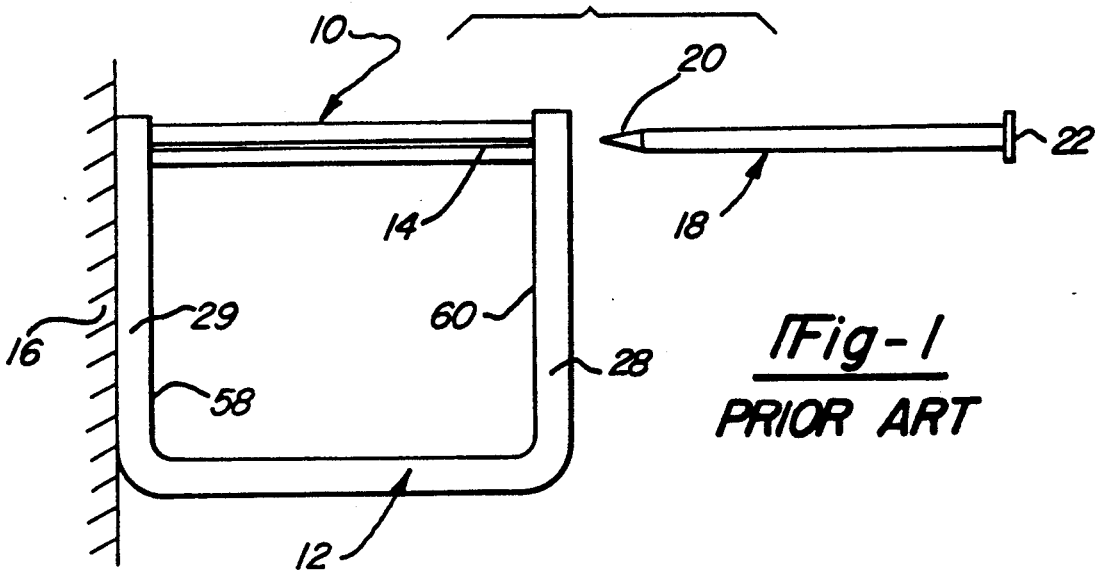
Fig-1
PRIOR ART
Fig-2
PRIOR ART
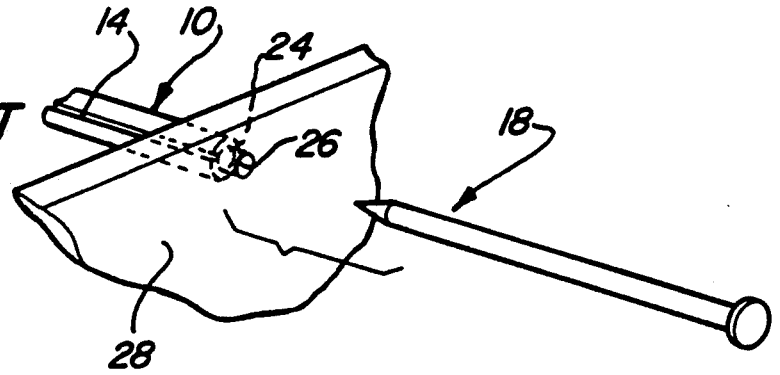
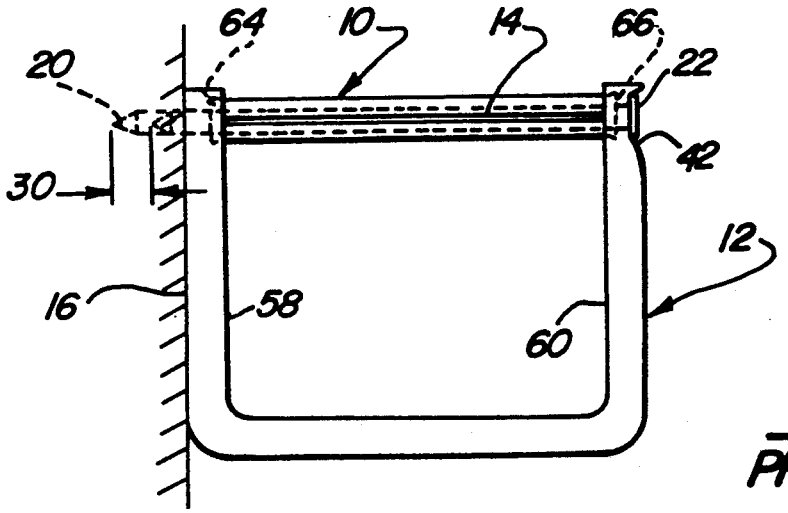
Fig-3
PRIOR ART

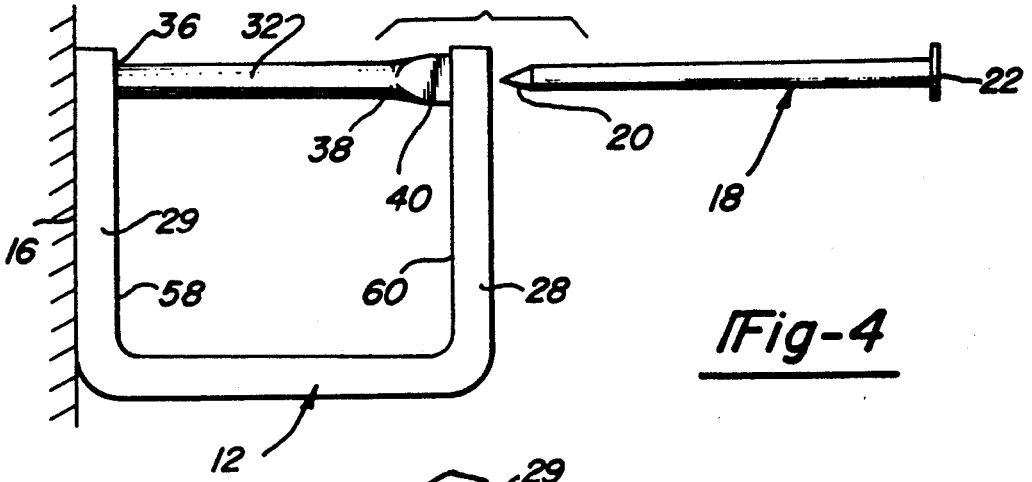
Fig-4
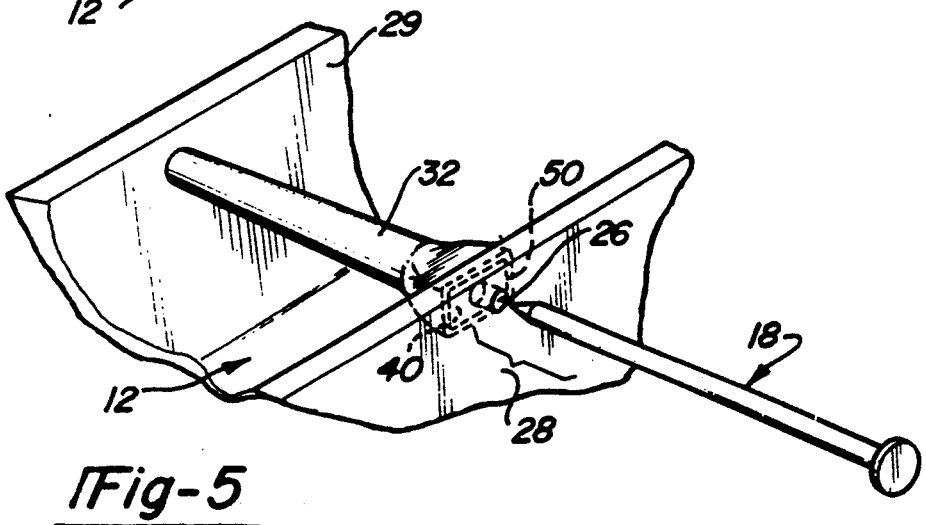
Fig-5
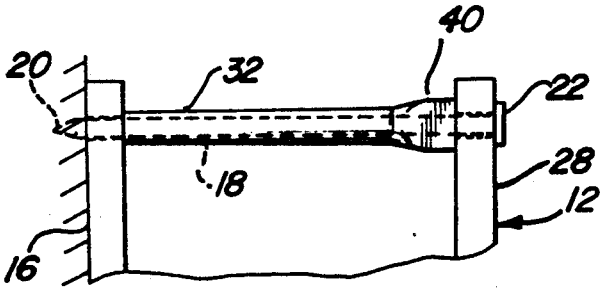
Fig-6
Fig-7D
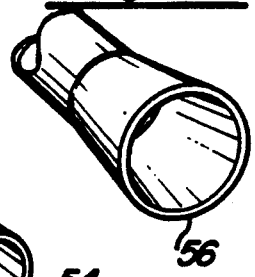
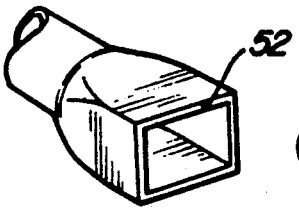
Fig-7B
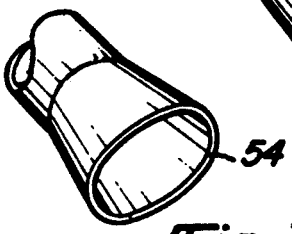
Fig-7C
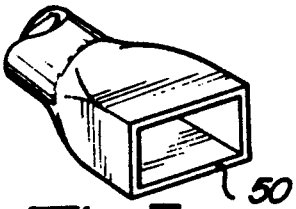
Fig-7A

GUTTER FERRULE

BACKGROUND OF THE INVENTION

This invention relates generally to a plastic ferrule and more specifically to a plastic ferrule for guiding a support spike used in supporting a gutter on the eave of a building.

Known gutter ferrules in the art are generally made from a metal, such as aluminum, formed into a tubular shape having a continuous diameter. A piece of metal is generally wrapped to form the tubular ferrule such that a seam with a spaced distance is formed. The ferrule is positioned on the inside and between opposite walls of the gutter to enable a support spike to be driven through both walls and the ferrule. The internal diameter of the ferrule is generally only slightly larger than the support spike, such that the support spike has to be positioned accurately to enable the spike to be driven through the ferrule. Misalignment of support spike with the ferrule can cause the spike to travel into the sides of the ferrule and through the seam splitting the seam apart.

The continuous diameter metal ferrule can also cause indentations in the gutter walls from spike over-travel. When hammering the support spike through the ferrule, a worker may force the spike farther than was intended into the backing on which the gutter is supported on. Due to the rigidity and diameter of the end of the metal ferrule, the ferrule may be forced into the walls of the gutter. This may form a concave indentation on the inner side of either wall of the gutter. The damage to the gutter may be extensive by forcing the ferrule well into the gutter walls.

SUMMARY OF THE INVENTION

It is the object of the present invention to eliminate the above-identified drawbacks of a metal gutter ferrule. The gutter ferrule of the present invention is made of plastic and specifically an ABS (acrylonitrile-butadiene-styrene) or polypropolene plastic. This enables the ferrule to be injection molded forming a continuous part without a seam. The elimination of the seam helps keep rain and other precipitation away from the support spike, thus helping eliminate rusting of the spike. Further, since the plastic ferrule does not have a seam, the support spike will not get caught or hung-up on the inside of the ferrule from misalignment of the ferrule, and the spike will thus travel easier down the ferrule.

Also, according to this invention, the gutter ferrule has a funnel shaped end portion providing a wider target area in which to start the support spike traveling through the ferrule. The body of the ferrule itself is generally tubular, however, the funnel shaped end portion can take on a variety of different shapes, including rectangular, square, oval or circular. Misalignment of the gutter ferrule with the support according to this invention, does not present a problem. The wider opening of the end of the funnel portion and the funnel shape enable a support spike driven into a misaligned ferrule to be directed accurately down the tube of the ferrule. In the preferred embodiment, the inner diameter of the tubular body of the gutter ferrule just below the funnel portion is at its largest diameter and progressively narrows to the other end where the internal diameter of the gutter ferrule is at its smallest. This further enables the insertion spike to be guided more accurately.

The funnel portion of the plastic gutter ferrule according to this invention further eliminates concave indentations caused by spike over-travel. With this invention, the wider face and less rigid plastic doesn't allow the ferrule to be forced into the inner side of either wall of the gutter thus, substantially eliminating concave indentation formed by hammering the support spike too far into the gutter backing.

The use of a plastic gutter ferrule over a metal gutter ferrule further includes the advantages of reduction in weight, cost, and fabrication time. Couple these properties with the ease of putting up a gutter using this invention and the advantages become readily apparent.

Additional objects, advantages, and features of the present invention will become apparent from the following description and appended claims, taken in conjunction with the accompanying drawings.

BRIEF DESCRIPTION OF THE DRAWINGS

An understanding of the preferred embodiment of this invention can be obtained from the following drawings, wherein:

FIG. 1 is a prior art end view of a gutter against a support backing;

FIG. 2 is a prior art cut-away perspective view showing the gutter, ferrule and a support spike;

FIG. 3 is a prior art end view of the gutter and gutter ferrule in which the support spike is inserted;

FIG. 4 is an end view of a gutter using a gutter ferrule according to the preferred embodiment of this invention;

FIG. 5 shows a cut-away perspective view of a gutter showing the gutter ferrule according to the preferred embodiment of this invention;

FIG. 6 shows an end view of the gutter ferrule according to the preferred embodiment of this invention in which the support spike has been inserted into the ferrule and the support backing;, and FIGS. 7A–7D are perspective views of some of the different shapes the circumference of the funnel end of the ferrule according to the preferred embodiment of this invention can take.

DETAILED DESCRIPTION OF THE DRAWINGS

The following descriptions are of exemplary embodiments of the invention and are intended to in no way limit the invention or any application of the invention.

FIG. 1 shows a prior art view of a gutter 12 against a backing structure 16, such as the eave of a roof, using a metal gutter ferrule 10 known in the art. The ferrule 10 guides a gutter support spike 18 through walls 28 and 29 of gutter 12. The support spike 18 has a pointed end 20 and a flat end 22. The pointed end 20 is positioned against wall 28. A worker then attempts to line up ferrule 10 with spike 18 by positioning ferrule 10 between inner faces 58 and 60 of walls 29 and 28, respectively or attempts to line up spike 18 with ferrule 10. The worker then hammers flat end 22 to drive pointed end 20 through wall 28, ferrule 10 and wall 29 and into backing 16 to support the gutter on backing 16. As is apparent, lining up ferrule 10 with spike 18 is difficult since the internal diameter of ferrule 10 is only slightly larger than the diameter of the spike.

The prior art gutter ferrule 10 generally is made of metal, such as aluminum, and has a seam 14 forming a gap along its entire length. The seam 14 is formed because the metal ferrule is generally made by wrapping a piece of metal into a tubular shape. The seam 14 enables rain and other moisture to contact the spike 18 encouraging rusting of the spike. The internal diameter 24 of the ferrule 10 is generally consistent from one end to the other.

As is apparent from FIG. 2, the internal diameter represented by 24 of prior art gutter ferrule 10 is just slightly larger than a hole 26 in wall 28 which is formed by driving spike 18 through the wall 28. Such a minor difference in diameter requires that the ferrule 10 be accurately aligned with the spike 18 such that spike 18 will be guided effectively. Misalignment of ferrule 10 could result in spike 18 impacting the internal wall of gutter ferrule 10 and could split or separate the ferrule 10 if the end 20 of spike 18 were forced into seam 14. Such an effect could happen from a minor misalignment of ferrule 10 and the spike 18. Greater misalignments could cause other obvious problems.

Another problem with the prior art gutter ferrule is shown by FIG. 3. In that figure, spike 18 has been driven through ferrule 10, forming holes in walls 28 and 29 and into the backing structure 16, as can be seen. When a worker drives spike 18 into the backing structure 16, the spike 18 may be forced a distance 30 more than what was intended. Due to the rigidity of the metal and the small diameter of the ferrule, the ends of ferrule 10 could be forced into one or both of walls 28 or 29 through faces 60 and 58 as shown by dotted portions 64 and 66. When the ends of ferrule 10 are forced into walls 28 and 29 a concave indentation is formed in faces 58 and 60 damaging the gutter.

FIG. 4 shows the preferred embodiment of this invention. In that figure, gutter 12 is again shown having side walls 28 and 29 for receiving spike 18. Instead of ferrule 10, ferrule 32 is shown according to this invention. Ferrule 32 also has an elongated tubular body portion. However, ferrule 32 is made of a plastic material such as ABS or polypropolene. Because ferrule 32 is plastic it can be made by injection molding. It therefore does not have a seam and is continuous all the way around. The tubular portion of ferrule 32 has a range from end 36 to end 38. Attached to end 38 is funnel portion 40. The plastic ferrule 32 is a single continuous piece, therefore the connection between end 38 and funnel portion 40 are also continuous. In the preferred embodiment, the internal diameter of the tubular section of ferrule 32 is smaller at end 36 than at end 38. This is because the tubular body portion has a constant taper from end 38 to end 36.

Approximate specifications for ferrule 32 of the preferred embodiment include an inner diameter at end 38 of 300 thousandths and an outer diameter at end 38 of 400 thousandths; an inner diameter at end 36 of 250 thousandths and an outer diameter at end 36 of 350 thousandths; an overall length of 5 inches, with 4.5 inches of that between ends 36 and 38 and 0.5 inches in length of funnel portion 40; and funnel portion 40 having an opening of 550 thousandths at its widest point. These approximate dimensions give a ferrule having an opening at one end with an area substantially larger than the area of the opening of the other end. The area of the opening at the funnel end is well over two times the area of the opening at the other end.

As can be seen from FIG. 5, the opening of funnel portion 40, having a rectangular end shape 50, is substantially larger than hole 26 formed by support spike 18. When a worker wishes to align gutter ferrule 32 with the support spike 18, he has a much easier time providing adequate alignment in which support spike 18 can accurately and easily be guided through the ferrule 32. The smooth interior of the ferrule and the continuous tapering efficiently guides the spike 18 through walls 58 and 60. Since ferrule 32 is made of plastic and completely enclosed, spike 18 is substantially free from moisture and thus rusting of spike 18 is reduced.

As shown in FIG. 6, ferrule 32 also reduces or eliminates concave indentation of the walls 28 and 29 of gutter 12 when spike 18 is being hammered into support 16. Since ferrule 32 is made of a plastic material it is less rigid than metal ferrule 10 and thus tends to give more. If a worker hammers spike 18 more times than are necessary to get the spike 18 to travel the desired distance to support the gutter, the ends of ferrule 32 will not be forced into and damage walls 28 and 29. This is mainly because instead of a metal ferrule against a metal gutter wall, you have a less rigid plastic against a metal gutter wall. Further, the wider opening of funnel portion 40 enables the hammering forces to be more widely distributed. Therefore, the spike does not go into the backing 16 too far and the gutter walls are not damaged.

The opening of funnel portion 40 of ferrule 32 can take on a variety of shapes. In the preferred embodiment the shape is rectangular. However, the same advantages of a rectangular shaped funnel portion can be realized by other shapes as well, as can be seen by FIG. 7(B)–(D) showing alternate embodiments. FIG. 7(A) shows the preferred rectangular shaped opening 50 of funnel portion 40. FIG. 7(B) shows a square shaped opening 52 of funnel portion 40. FIG. 7(C) shows an oval shaped opening 54 of funnel portion 40. FIG. 7(D) shows a circular shaped opening 56 of funnel portion 40. All of these shapes can easily be applied to a tubular shaped ferrule in a continuous fashion.

The use of a plastic ferrule over a metal ferrule has a number of advantages. These include ease of manufacture, cost of materials, and ease of producing different shapes. The gutter ferrule 32 can be fabricated by means of injection molding and therefore can easily take on the variety of shapes as disclosed. This same process enables the gutter ferrule to be continuous throughout. As disclosed above, this eliminates the seams that would be present in the metal ferrule. Further, the funnelled end portion and tapered body portion offer further advantages over the prior art ferrule as disclosed.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A device for guiding a support spike and adapted to be disposed in a gutter having opposed walls to form a gutter width, said device comprising:

a non-metallic elongated tubular portion of a first predetermined length having a first end and a second end, said tubular portion being circumferentially and longitudinally continuous between said first and second end; and a funnel portion having a second predetermined length, said funnel portion connected to said first end and longitudinally continuous therewith, said funnel portion being circumferentially continuous and further having an end defining an opening substantially wider tan an opening through said tubular portion, said first predetermined length being substantially greater than said second predetermined length, said first and second predetermined length defining a length substantially equal to the gutter width to guide the support spike between the opposed walls.

2. The device of claim 1 wherein the end of the funnel portion defining the opening of the funnel portion has a cross-section defined by one of either a rectangle, circle, oval or square.

3. The device of claim 1 wherein said first end is of a larger internal diameter than said second end.

4. The device of claim 1 wherein said device is made from ABS.

5. The device of claim 1 wherein said device is made from polypropolene.

6. A drainage gutter comprising:

a substantially rectangular trough like member having two side walls and a bottom for carrying away a fluid material, said side walls substantially the same distance apart at all locations to form a gutter width;

support spikes positioned at predetermined intervals to support said trough member on a structure, said support spikes being driven through said side walls; and plastic ferrules for guiding said spike through said walls, said ferrules comprising an elongated tubular portion and a funnel portion connected to one end of the tubular portion, said elongated tubular portion being circumferentially and longitudinally continuous and longitudinally continuous with said funnel portion, said funnel portion being circumferentially continuous, one end of said funnel portion defining an opening of the funnel portion which is substantially larger than the diameter of said support spikes and the internal diameter of the elongated tubular portion at its end opposite the funnel portion also being larger than the support spike, but substantially smaller than the opening of the funnel portion, said elongated tubular portion and funnel portion defining a length substantially equal to said gutter width.

7. The drainage gutter of claim 6 wherein the opening of the funnel portion has a rectangular cross-section.

8. The drainage gutter of claim 6 wherein the ferrules are made from ABS.

9. The diameter gutter of claim 6 wherein the ferrules are made from polypropolene.

10. The drainage of claim 6, wherein the internal diameter of the end of the tubular opening connected to the funnel portion is of a larger diameter than the internal diameter of the tubular opening at the other end.

11. A gutter ferrule for enclosing a support spike and adapted to be disposed in a gutter having opposed walls to form a gutter width, said ferrule comprising;

a longitudinally and circumferentially continuous elongated tubular portion having a first end of a first internal diameter and a second end of a second internal diameter, said tubular portion having a first predetermined length;

a funnel portion having a second predetermined length and connected to said first end in a longitudinal and circumferential continuous fashion, said funnel portion having an opening of an area at least twice as large as the area of the opening of the first end wherein said first internal diameter of said first end is larger than said second internal diameter of said second end and each point along said tubular portion has a larger internal diameter than another point closer to said second end, said first predetermined length being substantially greater than said second predetermined length, said first and second predetermined length defining a length substantially equal to the gutter width to guide the support spike between the opposed walls.

12. The gutter ferrule of claim 11, wherein the ferrule is made of plastic.

13. The gutter ferrule of claim 11, wherein the internal diameter of said first end is approximately 300 thousandths of an inch and the internal diameter of said second end is approximately 250 thousandths of an inch.

14. The gutter ferrule of claim 11, wherein an end of said funnel portion defines a rectangular opening of said funnel portion.

15. The gutter ferrule of claim 14, wherein the rectangular opening has dimensions of 450 and 550 thousandths of an inch.

16. The gutter ferrule of claim 11, wherein said first predetermined length is approximately 4.5 inches and said second predetermined length is approximately 0.5 inches.

* * * * *

UNITED STATES PATENT AND TRADEMARK OFFICE

CERTIFICATE OF CORRECTION

PATENT NO. : 5,098,223

DATED : March 24, 1992

INVENTOR(S) : Curtis A. Schoenherr and Glenn C. Pesti

It is certified that error appears in the above-identified patent and that said Letters Patent is hereby corrected as shown below:

Column 4, line 14, claim 1, (amendment dated 7/3/91, page 2, line 13, claim 1), "tan" should be --than--.

Column 6, line 1, claim 9, (application page 12, line 1, claim 9), "diameter" should be --drainage--.

Signed and Sealed this

Eighth Day of June, 1993

Michael K. Kirk

*Attest:*

MICHAEL K. KIRK

*Attesting Officer*

*Acting Commissioner of Patents and Trademarks*